US007121923B1

(12) United States Patent
Sweet

(10) Patent No.: US 7,121,923 B1
(45) Date of Patent: Oct. 17, 2006

(54) DUAL POSITION SHARPENING DEVICE

(75) Inventor: Edward G. F. Sweet, deceased, late of Burlington (CA); by Margaret Mary Sweet, legal representative, Burlington (CA)

(73) Assignee: Martin P. Gottlieb, Newark, DE (US)

( * ) Notice: Subject to any disclaimer, the term of this patent is extended or adjusted under 35 U.S.C. 154(b) by 0 days.

(21) Appl. No.: 11/379,414

(22) Filed: Apr. 20, 2006

(51) Int. Cl.
*B24B 7/02* (2006.01)

(52) U.S. Cl. ..... 451/11; 451/57; 451/278; 451/279; 451/293; 451/456; 51/122; 30/389

(58) Field of Classification Search ..... 451/11, 451/57, 65, 340, 349, 456, 278, 279, 293; 51/122; 30/389
See application file for complete search history.

(56) References Cited

U.S. PATENT DOCUMENTS

| | | | | |
|---|---|---|---|---|
| 1,581,919 | A * | 4/1926 | Case | 451/65 |
| 3,733,751 | A * | 5/1973 | Williams | 451/45 |
| 4,228,618 | A * | 10/1980 | Jensen | 451/414 |
| 4,259,814 | A * | 4/1981 | Glaser et al. | 451/273 |
| 4,373,299 | A * | 2/1983 | Gaston et al. | 451/273 |
| 6,676,495 | B1 | 1/2004 | Siemers et al. | |
| 6,748,836 | B1 * | 6/2004 | Vivirito et al. | 83/174 |

* cited by examiner

*Primary Examiner*—Lee D. Wilson
*Assistant Examiner*—Anthony Ojini
(74) *Attorney, Agent, or Firm*—Paul & Paul

(57) ABSTRACT

A dual position sharpening device can be set up so that the abrasive wheel is either vertical or horizontal. A guard retains cooling water in either position.

13 Claims, 8 Drawing Sheets

DUAL POSITION SHARPENING DEVICE

BACKGROUND OF THE INVENTION

1. Field of the Invention

The present invention relates to sharpening devices for edge tools such as chisels, gouges, planer blades, and the like.

2. Brief Description of the Prior Art

Sharpening devices and methods for tools date from prehistory. In modern times edge tools such as chisels are manufactured from hardened, tempered steel and have edges that can be sharpened by grinding with a suitable abrasive material or stone. While sharpening can be carried out be hand, by drawing the tool edge across the face of a stone, in a production environment it is easier to keep the tool edge fixed and move the stone. A conventional grinding apparatus employs a circular abrasive wheel rotated at constant angular speed by an electric motor. The wheel can be formed with a cylindrical peripheral surface parallel the axis of rotation, and the operator moves the tool edge into contact with the peripheral surface of the rotating wheel. Conventionally, the wheel is mounted vertically so that it rotates about a horizontal axis, and the operator move the tool in a generally horizontal plane.

The circular wheel provides a hollow grind. Often it is desirable, however, to provide a flat grind on the tool edge. This geometry provides a more durable, longer lasting edge. This can be accomplished by drawing the tool edge over a flat stone surface by hand. Alternatively, a rotating abrasive cup wheel or abrasive disk can be used. Human ergonomics and convention suggest that in this instance the abrasive wheel preferably rotate in a horizontal plane, and that the tool be moved into contact with the upper surface of the rotating wheel, in a generally horizontal plane.

Conventionally, grinding and honing form two distinct and successive stages in the preparation of the tool for use. Grinding consists of imparting the required geometry or shape to the cutting part of the tool. Next, honing consists of refining the leading or cutting edge so that it exhibits a high degree of sharpness. These two stages often require sharpening stones with different geometries (whether hand or powered) and made of different grades of abrasive. Hence more than one sharpening device may be employed to fully prepare the tool.

U.S. Pat. No. 6,676,495 discloses a powered sharpening system in which a generally horizontal turntable is used to rotate reversible, interchangeable platters carrying different grades of abrasive for grinding, polishing, and lapping woodworking and other edge tools. A belt and vertically mounted conventional sharpening wheel are also provided and driven by the same electric motor.

Grinding steel on an abrasive produces frictional heat. When sharpening is accomplished by hand, the frictional heat produced is likely dissipated on a time scale comparable to its generation and there is no significant heat build up. However, when the stone is driven mechanically, significant heat can be generated at a rate faster than dissipation, raising the temperature of both the stone and the work piece being sharpened. This is undesirable, because the tool is frequently a tempered steel, which can lose its temper if a critical temperature is exceed, hence weakening the tool.

Mechanical grinders can be provided with a cooling bath, such as a water-filled trough in which the wheel is partially submerged.

There is a need for a versatile sharpening device for edge tools that can provide a single sharpening wheel in either a vertical or horizontal orientation, while also maintaining the wheel in contact with a cooling fluid.

SUMMARY OF THE INVENTION

The present invention provides a dual position sharpening device. The device of the present invention provides an edge tool grinder and hone designed to allow hollow grinding, flat grinding and honing of edge tools by using either the periphery or face of an abrasive wheel or flat disk. The device employs a single abrasive wheel or disk at a time, mounted at one end of a rotating shaft, producing a compact machine with a small footprint. The device of the present invention provides for operating the abrasive wheel or disk in either a vertical or horizontal position. The device also preferably provides a continuous bath of coolant in either position, thus avoiding drawing the temper of the edge tool. The device preferably includes a reservoir, shaped to retain water (or other cooling fluid) in either position.

The device includes a saddle rotatable between a first position and a second position, and a rotatable shaft mounted on the saddle for receiving a generally cylindrical sharpening wheel or disk. Preferably, the saddle is mounted on a base for the device.

The rotatable shaft has a first axis of rotation. The device also includes a fluid-retaining guard-reservoir for receiving a cooling fluid. The guard-reservoir is rotatable between a first position and a second position about a second axis of rotation. The second axis of rotation is parallel to the first axis of rotation and is displaced from the first axis of rotation by a predetermined distance. The guard-reservoir is preferably shaped to retain a supply of cooling fluid in both the first position and the second position. Preferably, the guard-reservoir is translatable along the second axis of rotation.

It is also preferred that the saddle be rotatable between a first vertical position and a second horizontal position generally perpendicular to the first vertical position.

Preferably, the dual position sharpening device further includes a generally cylindrical hub for mounting the guard-reservoir. The hub is mounted on the base and has an aperture for the shaft, and through which the shaft extends. The guard-reservoir is rotatable about the hub, with the hub axis coinciding with the second axis. The guard-reservoir is translatable on the hub along the hub axis.

Preferably, the dual position sharpening device also includes a drive mechanism for rotating the shaft. For example, an electric motor, drive belt and pulleys can be provided.

In one presently preferred embodiment, the dual position sharpening device also includes a generally cylindrical sharpening wheel mounted on the shaft, the sharpening wheel being mounted on the shaft proximate the outer end of the shaft.

When an abrasive wheel is provided in a vertical position, the user can obtain a hollow ground edge by passing the tool over the perimeter of the wheel. When an abrasive wheel or disk is provided in the horizontal position, a flat ground edge is obtained by passing the tool over the face (side) of the wheel, or over coated abrasives, ceramic or abrasive diamond disks mounted on the disk. Honing is achieved by using very fine abrasives (coated or in the form of a diamond or ceramic disk) in the horizontal position.

Alternatively, a user can obtain a flat grind when the abrasive wheel is provided in the vertical position by working on the side of the wheel, provided a cup shaped (recessed in the middle of its face) wheel is used. The face of the flat disk may also be used in the vertical position to provide a flat grind. This is particularly advantageous for blades with a very wide edge, such as planer blades.

The dual position sharpening device of the present invention can also be used to perform other functions, such as the grinding or honing of flat surfaces (facets) on gems and semi-precious stones, the sharpening of engraving tools and knives, the honing of carbide cutting inserts, or any other use in which a controlled abrasive operation must be carried out in the presence of a coolant.

DETAILED DESCRIPTION

The present invention provides a dual position sharpening device that can be set up to be operated in either a horizontal position, in which the side face of a rotating abrasive wheel or disk is used as a sharpening surface, or in a vertical position, in which the peripheral edge of a rotating abrasive wheel can be used as a sharpening surface.

Figure 1:
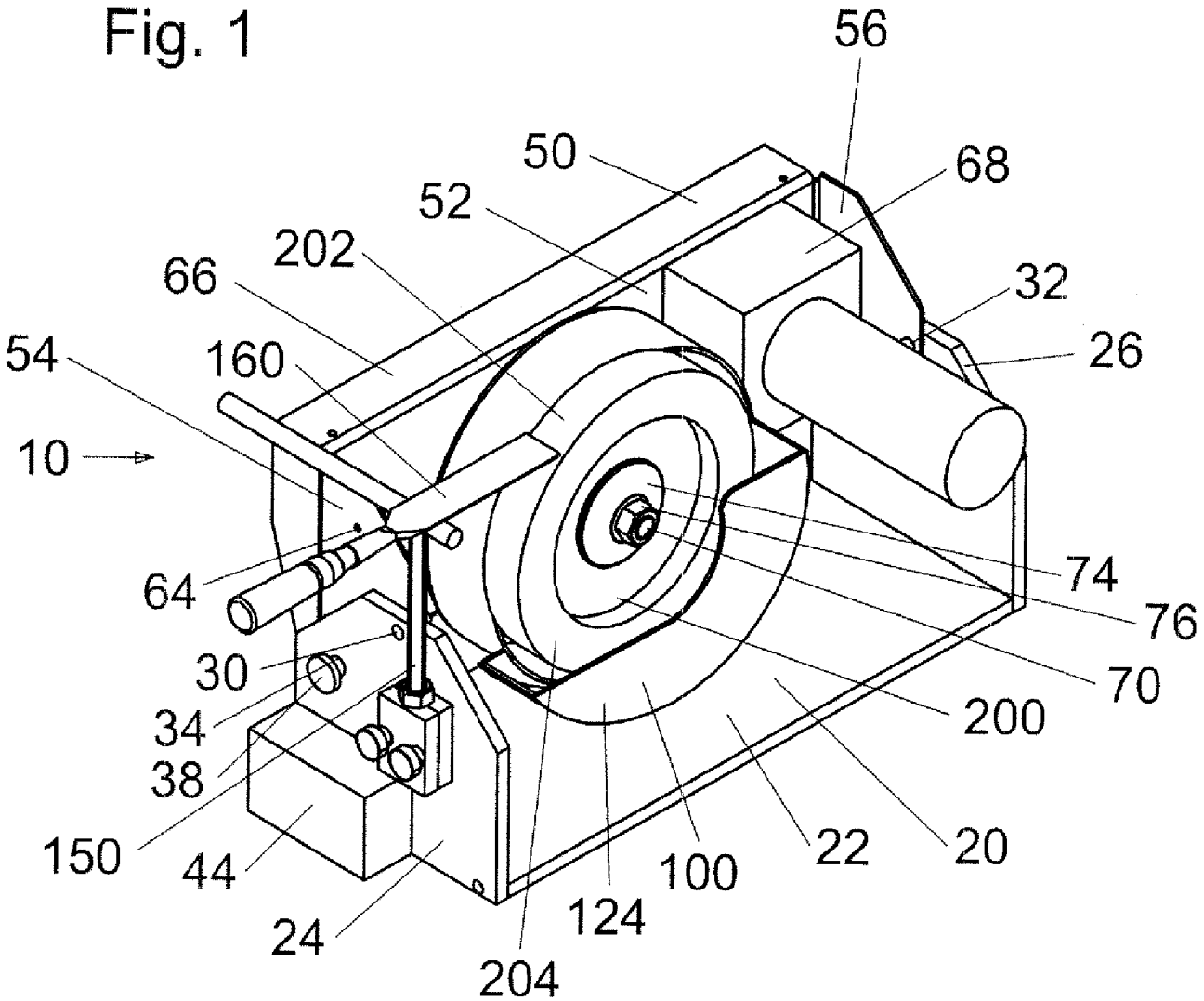
FIG. 1 is perspective view of a dual position sharpening device according to the present invention shown with the abrasive wheel in the vertical position.
Figure 2:
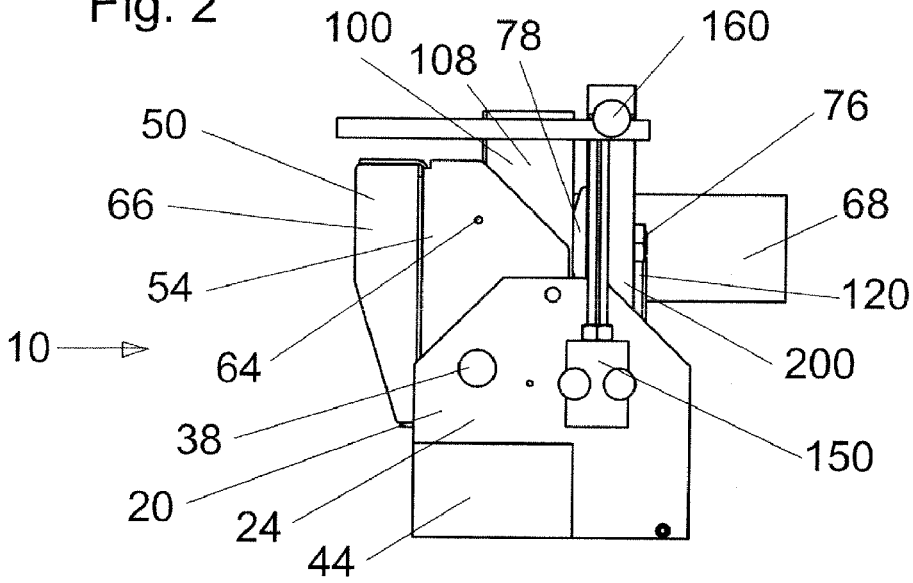
FIG. 2 is a front elevational view of the dual position sharpening device of FIG. 1.

Referring now to the drawings in detail, wherein like reference numerals indicate like elements throughout the several views, there is shown in FIG. 1 a perspective view of a dual position sharpening device 10 according to the present invention shown with an abrasive wheel 200 in a vertical position. The sharpening device 10 includes a generally "U"-shaped base 20 including a rectangular bottom plate 22 from which extend upwardly at the ends thereof a generally rectangular front plate 24 and a generally rectangular rear plate 26. The front plate 24, bottom plate 22 and rear plate 26 are preferably formed from a strong dimensionally stable material such as steel or aluminum plate and are joined by welding or with suitable fasteners. Alternatively, the front plate 24, bottom plate 22 and rear plate 26 of the base 20 can be formed by stamping a single metal workpiece, by forming a casting followed by suitable machining operations, etc.

Fixed and centered proximate the upper edge of the front plate 24 is an inwardly extending front pivot pin 30. Similarly, fixed and centered proximate the upper edge of the rear plate 26 is an inwardly extending rear pivot pin 32. The front pivot pin 30 and the rear pivot pin 32 share a common axis. A front lock aperture 34 is formed in the front plate 24 proximate a side edge, in which is mounted a front lock fastener or screw 38. Similarly, as shown in the top plan view of FIG. 3, a rear lock aperture 36 is formed in the rear plate 26 proximate a side edge, and in which is mounted a rear lock fastener or screw 40.

As shown in FIG. 1, a control box 44 is mounted on the front plate 24 proximate the bottom edge thereof for housing electrical components for controlling the operation of the sharpening device 10 such as switches, indicator lamps, fuses, and the like (not shown).

The base 20 is preferably placed on, bolted to, or otherwise secured to the top of a bench or other work surface. In addition, a tool rest 150 is secured to the front plate 24 of the base 20 so that the position of an edge tool 160 such as a chisel or gouge being sharpened can be precisely controlled by the operator.

Figure 5:
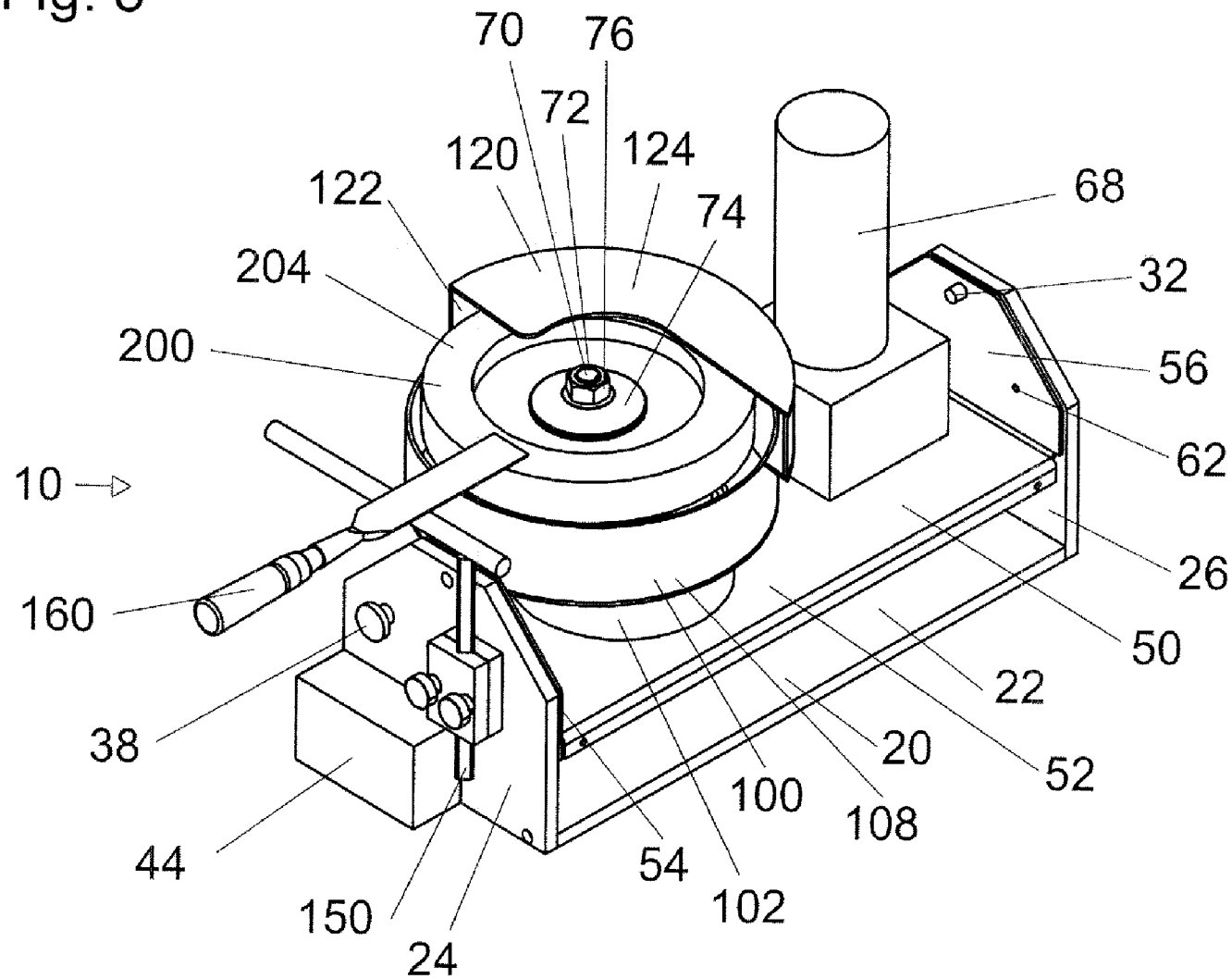
FIG. 5 is perspective view of a dual position sharpening device according to the present invention shown with the abrasive wheel in the horizontal position.
Figure 7:
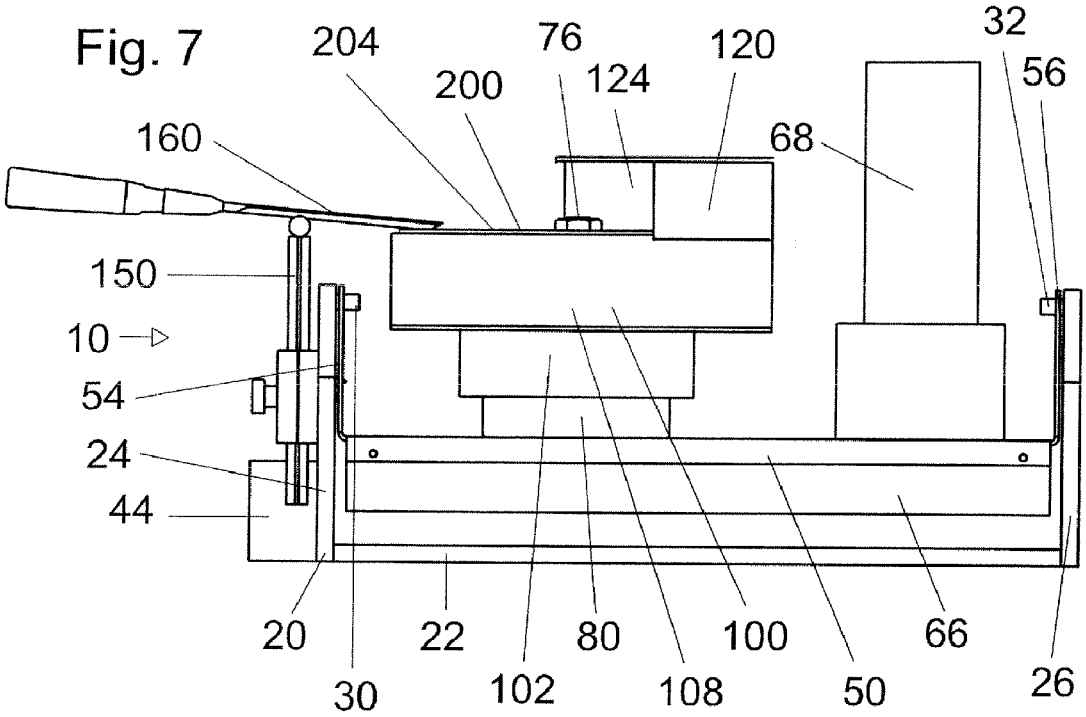
FIG. 7 is a side elevational view of the dual position sharpening device of FIG. 5 as seen from the right side.
Figure 8:
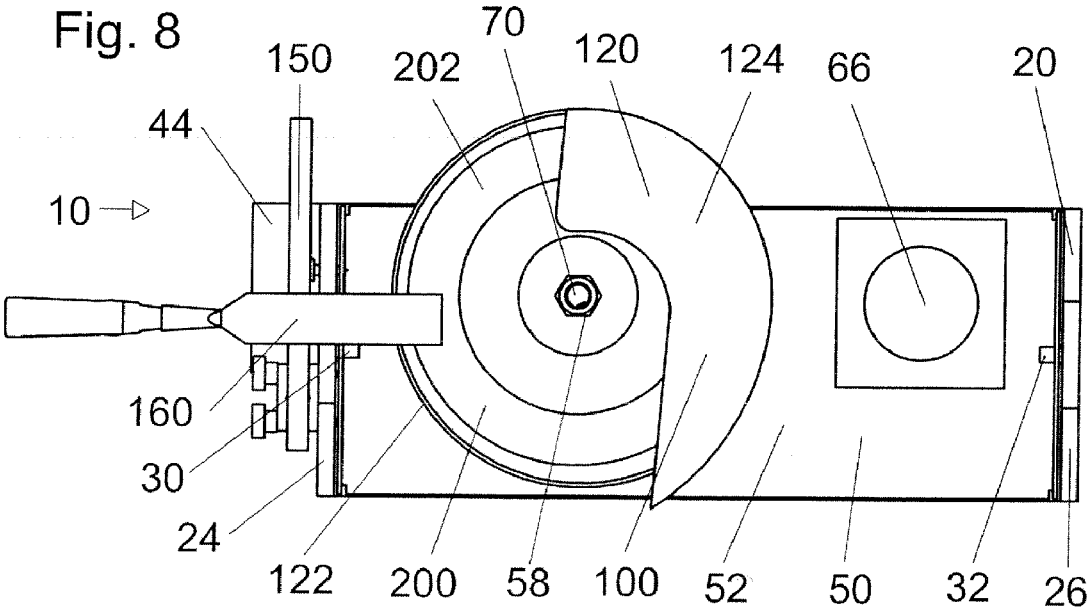
FIG. 8 is a top plan view of the dual position sharpening device of FIG. 5.

Nesting within and rotatably mounted on the base 20 is a pivoting, generally "U"-shaped saddle 50, which includes a rectangular base plate 52, from which extend at the ends thereof a generally rectangular front saddle plate 54 and a generally rectangular rear saddle plate 56, best seen in FIGS. 5 and 7.

Mounted on the saddle 50 are an electric motor 68 for powering the sharpening device 10, as well as an eccentric hub 80 (FIGS. 7, 9–12), through which protrudes a main shaft 70 on which is mounted a generally cylindrical abrasive wheel 200 or abrasive disk (not shown). The motor 68 is mounted to the saddle 50 at its rear, behind the eccentric hub 80. Thus, these other components of the sharpening device 10 are secured to the saddle 50 such that they all move when the saddle 50 does.

The front plate 54 of the saddle 50 includes a front pivot aperture 58 formed proximate the upper end thereof for rotatably receiving the front pivot pin 30, and the rear plate 56 of the saddle 50 includes a rear pivot aperture 60 for receiving the rear pivot pin 32. The saddle 50 pivots on the pivot pins 30, 32.

Figure 4:
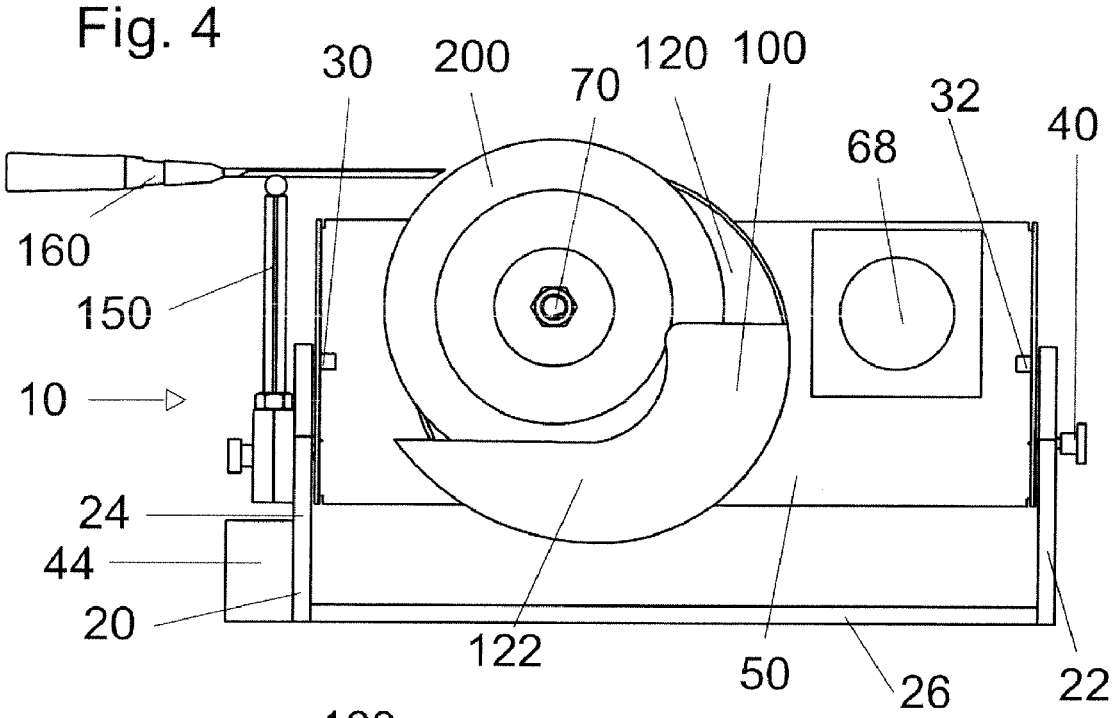
FIG. 4 is a side elevational view of the dual position sharpening device of FIG. 1 as seen from the right side.

The front plate 54 of the saddle 50 and the rear plate 56 of the saddle 50 also each include a vertical position locking aperture 62 (visible in FIG. 5) for receiving the front lock screw 38 and the rear lock screw 40 (visible in FIG. 4) respectively for locking the saddle 50 in a vertical position, such as shown in FIG. 1. The front plate 54 of the saddle 50 and the rear plate 56 of the saddle 50 also each include a horizontal position locking aperture 64 (visible in FIG. 1) for receiving the front lock screw 38 and the rear lock screw 40 respectively for locking the saddle 50 in a horizontal position, such as shown in FIG. 5.

To move the saddle 50 from a horizontal position to a vertical position, the front lock screw 38 and the rear lock screw 40 are unfastened from the horizontal locking apertures 64 to unlock the saddle 50 from the base 10, and the saddle 50 is swung manually from the horizontal position to the vertical position. The front lock screw 38 and the rear lock screw 40 are then engaged in the vertical locking apertures 62 to lock the saddle 50 in the vertical position. To move the saddle 50 from the vertical position to the horizontal position, the process is reversed. The front lock screw 38 and rear lock screw 40 can be conventional thumbscrews, in which case the corresponding front lock aperture 34 and rear lock aperture 36 are threaded to engage the threaded portions of the thumbscrews, or sprung quick-release fasteners can be employed.

As can be seen in FIGS. 5 and 7, the saddle 50 also includes a safety guard or cover 66 extending over the lower surface of the base plate 52 of the saddle 50. The motor 68 includes a spindle (not shown) which extends through the base plate 52 of the saddle 50 and on which is fixedly mounted a first or drive pulley (not shown). An inner end (not shown) of the main shaft 70 also extends through the base plate 52 of the saddle 50. A second or driven pulley (not shown) is fixed on the inner end of the main shaft 70, and a conventional drive belt (not shown) extends between the two pulleys to transmit power from the motor 68 to the main shaft 70. The motor is preferably a one-quarter h.p. electric motor having a torque of 45 inch-lb. (5.1 nm) and an operating speed of from 200 to 800 rpm. The belt drive is selected to rotate the abrasive wheel at an effective working rate. If desired, the motor can be electronically controlled to provide a variable speed. A reversible motor can also be employed if desired.

The main shaft or spindle 70 carries the abrasive wheel or disk 200 at its outer end 72 and a pulley wheel (not shown) at the its inner end. The main shaft 70 is threaded at its outer end 72 to permit the abrasive wheel 200 to be securely fastened to the shaft with a outer collar 74, inner collar 78, and retaining nut 76, best seen in FIGS. 1, 3 and 5. The main shaft 70 is supported by the upper bearing and a lower bearing which permit the main shaft 70 to rotate.

Figure 9:
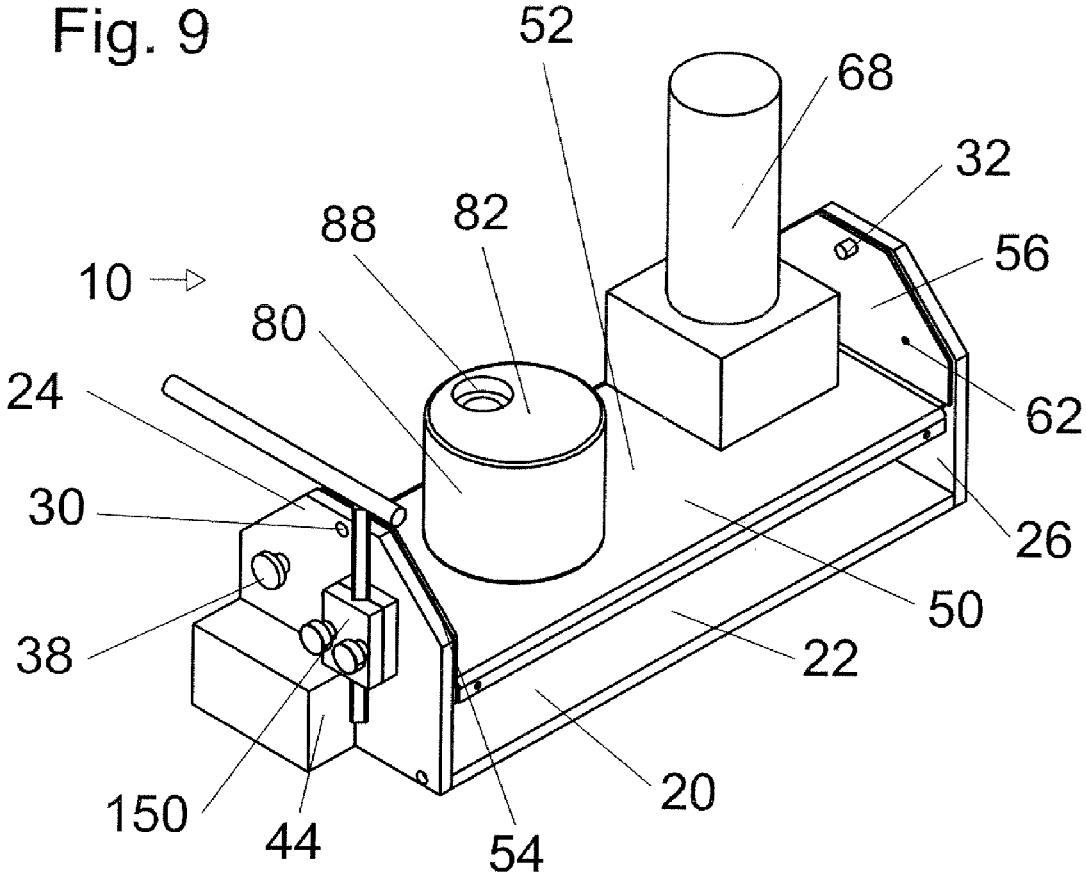
FIG. 9 is a perspective view of the sharpening device of FIG. 5 shown with the abrasive wheel, the guard-reservoir, shaft and upper bearing omitted to show the cylindrical hub.
Figure 10:
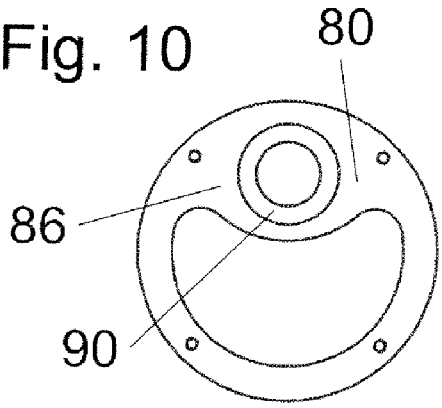
FIG. 10 is a bottom plan view of the cylindrical hub visible in FIG. 9.
Figure 11:
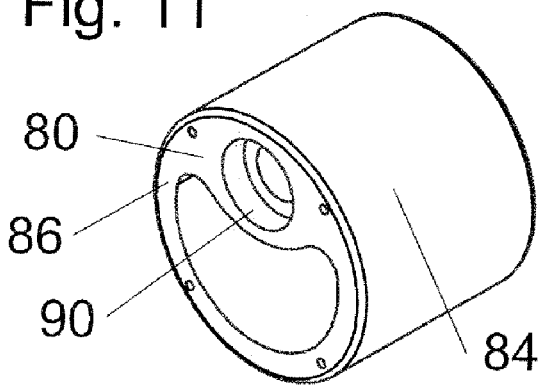
FIG. 11 is a perspective view of the cylindrical hub of FIG. 10 as seen from below the hub.
Figure 12:
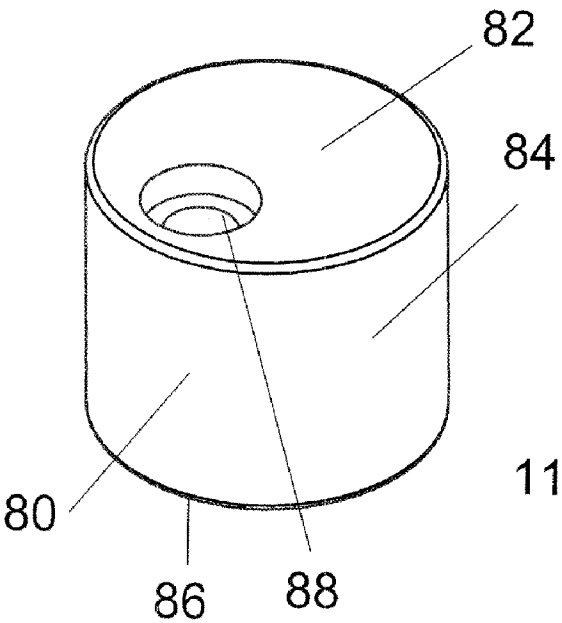
FIG. 12 is a perspective view of the cylindrical hub of FIG. 10 as seen from above the hub

A best seen in the perspective view of FIG. 9, which shows the sharpening device 10 with the abrasive wheel 200, the guard-reservoir 100, and the main shaft 70 omitted, a cylindrical hub 80 is mounted on the upper surface of the base plate 52 of the saddle 50. As best seen in FIGS. 10–12, the hub 80 includes a generally circular upper end 82 parallel a generally circular lower end 86 by a cylindrical hub side wall 84. Formed in the upper end 82 and lower end 86 of the hub 80, and aligned on a common axis parallel to but spaced from the central axis (that is, the axis of rotational symmetry) of the hub 80 are an upper bearing well 88 and a lower bearing well 90 for receiving a pair of ball bearings (not shown) for receiving and rotationally mounting the main shaft 70. The bearings can be press fit into the wells 88, 90 or retained by suitable fasteners.

The hub 80 is an "eccentric hub" in the sense that common axis of the bearing wells 88, 90 is parallel to but is placed off center (is eccentric) from the central axis of the hub 80.

The guard-reservoir 100, best seen in FIGS. 13–16, is mounted on the side wall 84 of the hub 80 so that the guard-reservoir 100 can be both manually rotated on the hub 80, and moved up and down on the hub 80 (that, is away and towards the base plate 52 of the saddle 50). The guard reservoir 100 is shaped to retain cooling fluid, forming a bath for the abrasive wheel 200, when the saddle 50 is in either the horizontal position or vertical position. When the saddle 50 is in the vertical position, geometry of the guard-reservoir 100 also provides a predetermined clearance between the guard-reservoir 100 and the abrasive wheel 200.

Figure 13:
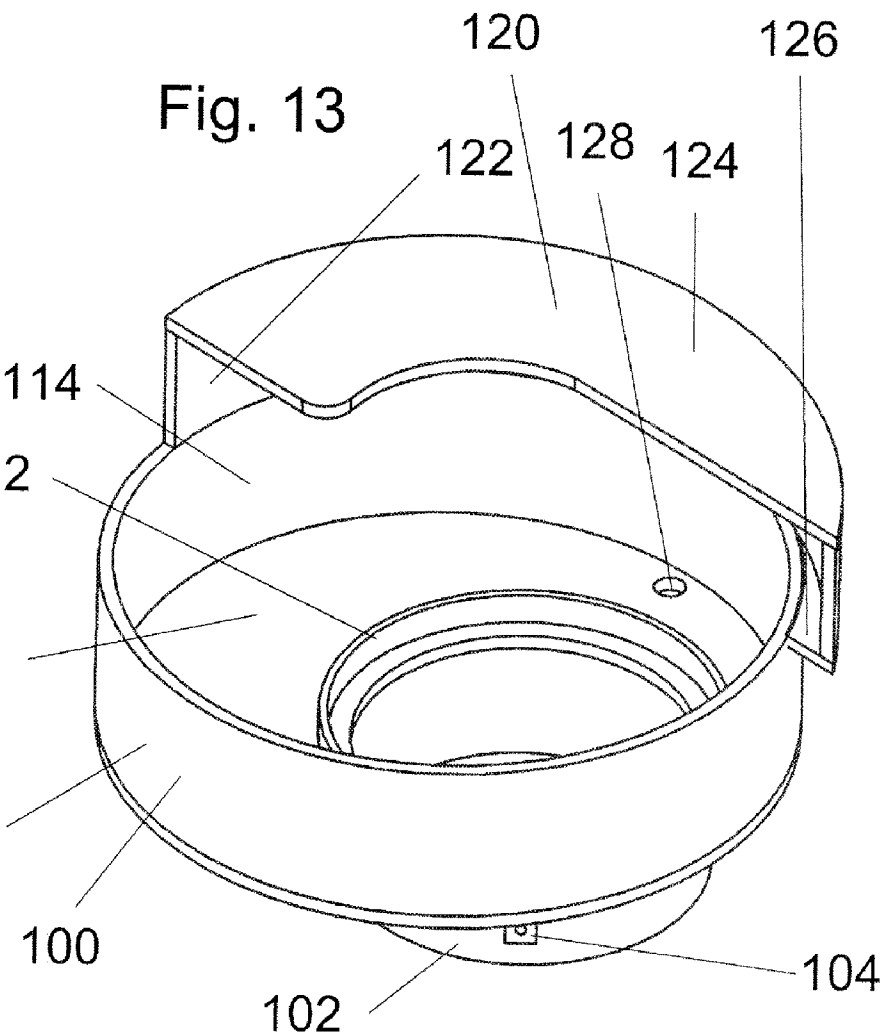
FIG. 13 is an expanded perspective view of the guard-reservoir of the dual position sharpening device of FIG. 1 as seen from above.
Figure 14:
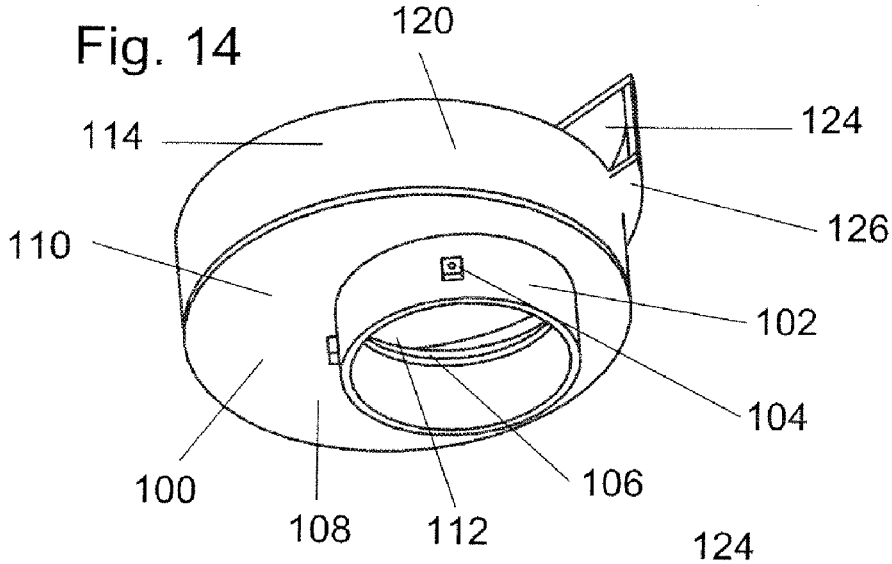
FIG. 14 is a perspective view of the guard-reservoir of FIG. 13 as seen from below.

As best seen in FIGS. 13 and 14, the guard reservoir 100 has two main sections, a lower section 102 and an upper section 108.

The guard reservoir 100 includes a cylindrical lower section 102 having an interior diameter slightly larger than the exterior diameter of the hub 80, thus forming a cylindrical collar sized to fit the outside of the eccentric hub 80. A pair of fasteners, such as thumbscrews, are mounted in reinforced, threaded apertures 104 the lower section 102 of the guard reservoir 100 for manually securing the guard reservoir 100 to the hub 80 (FIG. 14).

When a user wants to shift the sharpening device 10 from vertical operation to horizontal operation, the user manipulates the guard-reservoir 100 such that the lower section 102, riding on the exterior surface of the eccentric hub 80, undergoes both a rotary motion and a lateral motion, such as described below.

As shown in FIG. 14, a gasket 106 is mounted inside the lower section 102 of the guard reservoir 100 proximate the upper end thereof for sealing the gap between the interior of the lower section 102 of the guard reservoir 100 and the hub 80 against the passage of fluid.

Figure 15:
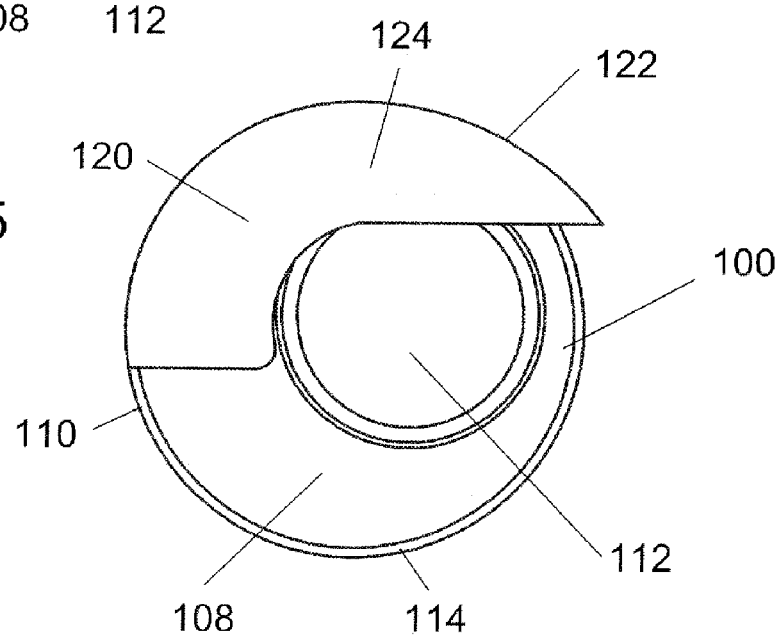
FIG. 15 is a top plan view of the guard-reservoir of FIG. 13.
Figure 16:
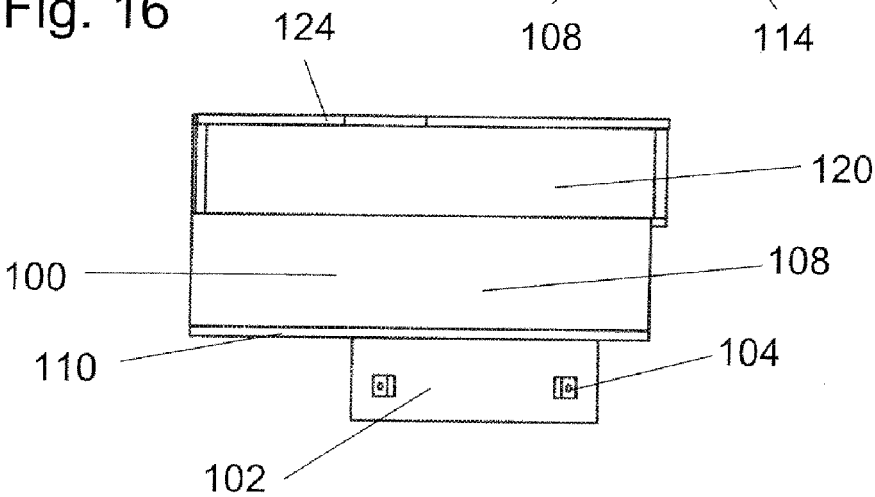
FIG. 16 is a side elevational view of the guard-reservoir of FIG. 13.

Extending from the upper end of the lower section 102 is a generally cylindrical upper section 108 of the guard-reservoir 100. The upper section 108 of the guard-reservoir 100 includes a circular base 110 having a circular aperture 112 formed therein for receiving the lower section 102 of the guard-reservoir 100. When the guard-reservoir 100 is mounted on the hub 80 (FIG. 9), the hub 80 extends through the circular aperture 112 formed in the base 110 of the upper section 108 of the guard-reservoir 100. As best seen in FIG. 15, the center of the circular aperture 112 is offset from the center of the circular base 110, so that when the guard-reservoir 100 is rotated on the hub 80, the guard-reservoir 100 moves eccentrically with respect to the rotational axis of the hub 80. This has the effect of providing clearance for the abrasive wheel 200 in the vertical position.

Figure 6:
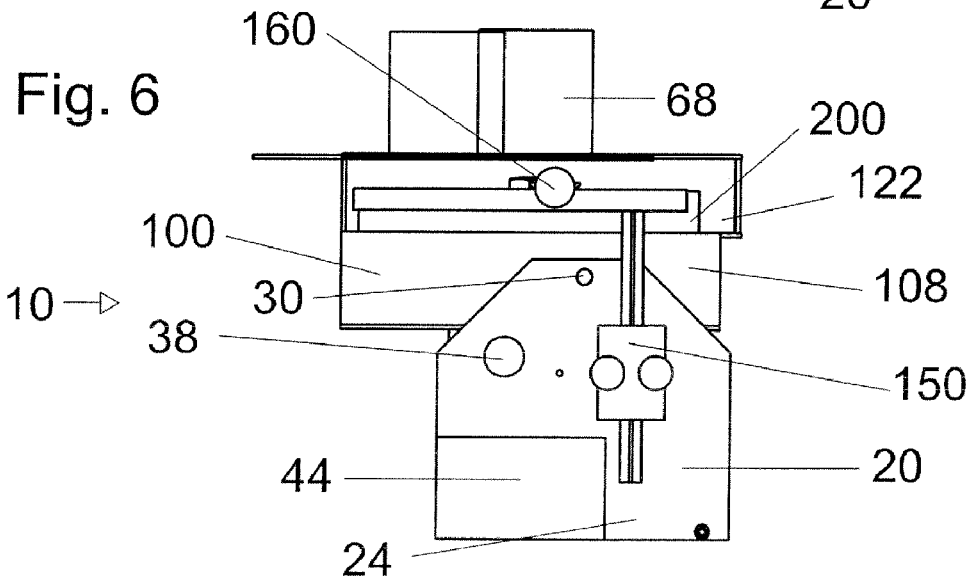
FIG. 6 is a front elevational view of the dual position sharpening device of FIG. 5.

The upper section 108 of the guard-reservoir 100 also includes a cylindrical side wall 114 extending outward from the outer edge of the base 110 of the upper section 108. As best seen in FIG. 6, the height of the upper section 108 is chosen to be slightly greater than the expected maximum thickness of the abrasive wheels to be employed on the sharpening device 10, and the diameter of the upper section is chosen to be slightly larger than the maximum diameter of the abrasive wheels to be used on the sharpening device 10.

As best seen in FIG. 13, extending from the upper or outer end of the upper section 108 is an irregularly shaped guard 120 including a guard base wall 122 which extends outward a uniform distance from the outer edge of a portion of the side wall 114 of the upper section 108, except at one end thereof. The guard 120 also includes an irregularly shaped outer wall 124 extending from the outer edge of the guard base wall 122 parallel the base 110 of the upper section 100. At one end the guard base wall 122 deviates outward from the side wall 114 of the upper section 108, and a generally triangularly shaped inner guard wall 126 extends between the guard base wall 122 and the side wall 114 of the upper section 108.

The upper section 108 and guard 120 form a reservoir that retains cooling fluid for the abrasive wheel 200. In operation of the sharpening device 10, the guard-reservoir 100 is provided a quantity of cooling fluid, such as water. When the saddle 50 is in the horizontal position such as shown in FIG. 5, the position of the guard-reservoir 100 on the hub 80 can be adjusted so that the cooling fluid contacts the lower face and at least a portion of the outer edge of the abrasive wheel 200.

When the saddle 50 is pivoted to the vertical position, such as shown in FIG. 1, the position of the guard-reservoir 100 on the hub 80 can be adjusted by rotating the guard-reservoir 100 on the hub 80 and pushing the guard-reservoir 100 downward on the hub 80 towards the base plate 52 of the saddle 50 so the edge of the abrasive wheel 200 is fully exposed, but the cooing fluid is maintained within the guard-reservoir 100 between outer guard wall 124 and the base 110 of the upper section 108. If desired, an active or passive pump mechanism can be provided (not shown) to circulate cooling water over the edge of the abrasive wheel 200.

When the set-up of the sharpening device 10 is changed from horizontal operation to vertical operation, the rotation of the guard-reservoir 100 around the central axis of the hub 80, taken with the eccentric position of the main shaft 70 with respect to the central axis of the hub 80, has the effect of providing suitable clearance between the interior surface of the guard-reservoir 100 and the perimeter of the abrasive wheel 200 or mounting plate.

As can be seen in FIG. 13, a drain hole 128 is provided in the base 110 of the upper section 108 so that cooling fluid can be drained from the guard-reservoir 100 when desired.

Figure 3:
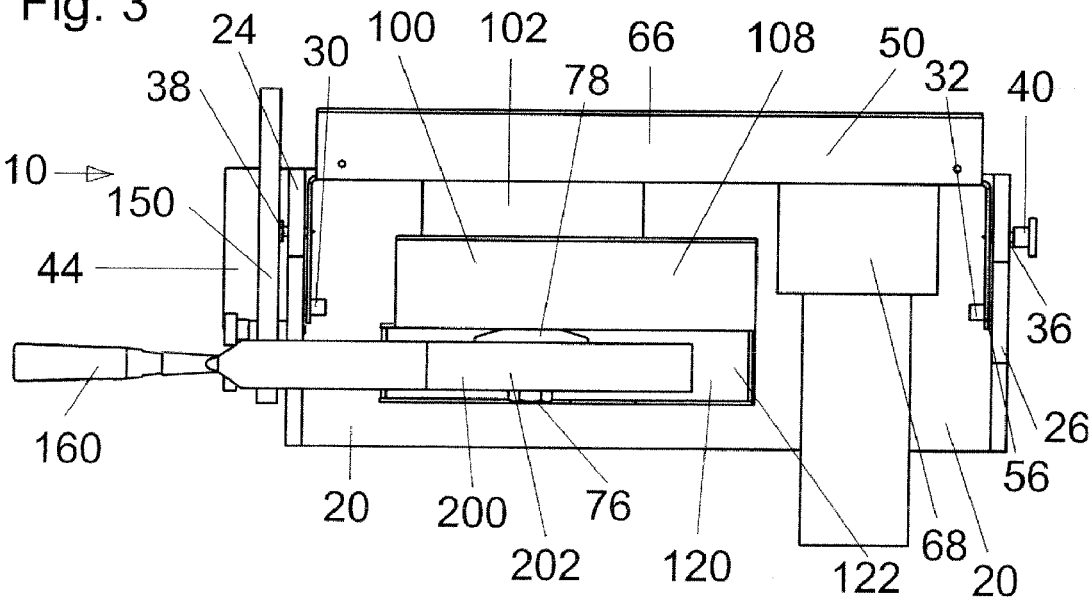
FIG. 3 is a top plan view of the dual position sharpening device of FIG. 1.

As best seen in FIG. 3, the abrasive or grinding wheel 200 is mounted to the main shaft 70 and held in place by a front collar 74, a rear collar 78, and a retaining nut 76. The abrasive wheel 200 can have a rectangular cross-section or have a recess (cup) formed in its side, such as depicted in FIG. 5 et al. As an alternative to use of an abrasive wheel 200, a flat, circular plate (not shown) can be employed. Such plates can bear coated abrasives in sheet form. Alternatively, the flat plate can be a ceramic honing disk, a metal disk coated with a diamond abrasive, or the like.

The tool rest 150, visible in FIGS. 1–9, can be adjustable in height, and the distance and orientation of the tool rest 150 with respect to the abrasive wheel 200 can be adjustable, if desired.

When the sharpening device 10 is set up in a horizontal position, such as shown in FIG. 5, both the guard-reservoir 100 and the abrasive wheel 200 are horizontal. When the sharpening device 100 is set up in the horizontal position, the saddle 50 is below the guard-reservoir 100, and nested within the base 20, while the guard-reservoir 100 is at the upper or outer limit of its travel along the length of the hub 80 (best seen in FIG. 7). When the guard-reservoir 100 is in this position, the abrasive wheel 200 or flat plate is recessed within the guard-reservoir 100, which has a side wall 114 high enough to retain the cooling fluid. The fluid in the guard-reservoir 100 is preferably circulated over the horizontal working face of the abrasive wheel 200 or flat plate by means of a small pump (not shown), thus cooling the upper abrading surface 204 and the item being ground.

In order to convert the sharpening device 100 from horizontal operation to vertical operation, the user pivots the saddle 50 through a 90-degree arc. This has the effect of moving all the parts carried by the saddle 50, including the eccentric hub 80 and guard-reservoir 100, to a vertical position. Simultaneously, the user shifts the guard-reservoir 100 toward the saddle 50 (to the left as the sharpening device 10 is depicted in FIG. 1) and rotates the guard-reservoir 100 about 90 degrees around the central axis of the eccentric hub 80 (clockwise as the sharpening device 10 is depicted in FIG. 5). Moving the guard-reservoir towards the saddle 50 has the effect of positioning the abrasive wheel 200 within the upper section 108 or open part of the guard-reservoir 100, while rotating the guard-reservoir 100 90 degrees clockwise moves the guard-reservoir 100 toward the rear of the sharpening device 10, providing clearance between the guard-reservoir 100 and the abrasive wheel 200 when the sharpening device 10 is set up in the vertical position. With the guard-reservoir 100 in this position, the user can move an edge tool 160 laterally across the outer edge or perimeter 202 of the abrasive wheel 200 without contacting the guard-reservoir 100 (FIG. 1). While it is the guard-reservoir 100 that is actually moved, the user may perceive the abrasive wheel 200 as moving forward of the guard-reservoir 100.

When these movements are complete the user fixes the saddle 50 in place with lock screws or pins 38, 40 and the sharpening device 10 is ready to use in the vertical position. To change back the sharpening device 10 from the vertical position to the horizontal position, the above steps are performed in reverse order.

Various other modifications can be made in the details of the various embodiments of the apparatus of the present invention, all within the scope and spirit of the invention and defined by the appended claims.

The invention claimed is:

1. A dual position sharpening device comprising:

(a) a saddle rotatable between a first position and a second position;

(b) a rotatable shaft mounted on the saddle for receiving a generally cylindrical sharpening wheel, the rotatable shaft having a first axis of rotation;

(c) a fluid-retaining guard-reservoir for receiving a cooling fluid, the guard reservoir being rotatable between a first position and a second position about a second axis of rotation, the second axis of rotation being parallel to the first axis of rotation, the second axis of rotation being displaced from the first axis of rotation by a predetermined distance, the guard-reservoir being shaped to retain a supply of cooling fluid in both the first position and the second position.

2. A dual position sharpening device according to claim 1 wherein the guard reservoir is translatable along the second axis of rotation.

3. A dual position sharpening device according to claim 1 wherein the saddle is rotatable between a first vertical position and a second horizontal position generally perpendicular to the first vertical position.

4. A dual position sharpening device according to claim 1 further comprising a generally cylindrical hub for mounting the guard reservoir, the hub being mounted in the base and having an aperture for the shaft, the shaft extending through the aperture in the hub, the guard-reservoir being rotatable about the hub, the hub axis coinciding with the second axis, the guard-reservoir being translatable on the hub along the hub axis.

5. A dual position sharpening device according to claim 1 further comprising a drive mechanism for rotating the shaft.

6. A dual position sharpening device according to claim 1 further comprising a generally cylindrical sharpening wheel mounted on the shaft, the shaft having an outer end, the sharpening wheel being mounted on the shaft proximate the outer end of the shaft.

7. A dual position sharpening device according to claim 1 further comprising a base for mounting the saddle.

8. A dual position sharpening device comprising:

(a) a saddle rotatable between a first vertical position and a second horizontal position generally perpendicular to the first vertical position;

(b) a rotatable shaft mounted on the saddle for receiving a generally cylindrical sharpening wheel, the rotatable shaft having a first axis of rotation;

(c) a fluid-retaining guard-reservoir for receiving a cooling fluid, the guard reservoir being rotatable between a first position and a second position about a second axis of rotation, the second axis of rotation being parallel to the first axis of rotation, the second axis of rotation being displaced from the first axis of rotation by a predetermined distance, the guard-reservoir being shaped to retain a supply of cooling fluid in both the first position and the second position.

9. A dual position sharpening device according to claim 8 wherein the guard reservoir is translatable along the second axis of rotation.

10. A dual position sharpening device according to claim 8 further comprising a generally cylindrical hub for mounting the guard reservoir, the hub being mounted in the base and having an aperture for the shaft, the shaft extending through the aperture in the hub, the guard-reservoir being rotatable about the hub, the hub axis coinciding with the second axis, the guard-reservoir being translatable on the hub along the hub axis.

11. A dual position sharpening device according to claim 8 further comprising a drive mechanism for rotating the shaft.

12. A dual position sharpening device according to claim 8 further comprising a generally cylindrical sharpening wheel mounted on the shaft, the shaft having an outer end, the sharpening wheel being mounted on the shaft proximate the outer end of the shaft.

13. A dual position sharpening device according to claim 8 further comprising a base for mounting the saddle.

* * * * *